US006109882A

United States Patent [19]

Popov

[11] Patent Number: 6,109,882

[45] Date of Patent: Aug. 29, 2000

[54] OPERATING MODE OF A JET BLOWER

[76] Inventor: Serguei A. Popov, 4615 Post Oak Pl. Suite 140, Houston, Tex. 77027

[21] Appl. No.: 09/194,413

[22] PCT Filed: Mar. 30, 1998

[86] PCT No.: PCT/RU98/00094

§ 371 Date: Nov. 30, 1998

§ 102(e) Date: Nov. 30, 1998

[87] PCT Pub. No.: WO98/44262

PCT Pub. Date: Sep. 24, 1998

[30] Foreign Application Priority Data

Mar. 31, 1997 [RU] Russian Federation ..... 97105015

[51] Int. Cl.[7] ..... F04F 19/24; F04B 19/24

[52] U.S. Cl. ..... 417/53; 417/54; 417/189

[58] Field of Search ..... 417/46, 54, 77, 417/189, 53

[56] References Cited

U.S. PATENT DOCUMENTS

| | | | |
|---|---|---|---|
| 2,382,391 | 8/1945 | Berman | 417/198 |
| 3,796,640 | 3/1974 | Boomer | 203/11 |
| 4,136,530 | 1/1979 | Kantor | 62/499 |
| 4,388,045 | 6/1983 | Simon | 417/54 |
| 4,448,347 | 5/1984 | Dunstan | 237/2 B |
| 4,828,768 | 5/1989 | Talmor | 261/116 |
| 5,214,157 | 5/1993 | Healy et al. | 549/250 |
| 5,628,623 | 5/1997 | Skaggs | 417/151 |

FOREIGN PATENT DOCUMENTS

| | | |
|---|---|---|
| 2016262 | 7/1994 | Russian Federation . |
| 2048156 | 11/1995 | Russian Federation . |
| 754118 | 8/1980 | U.S.S.R. . |
| 1302031 | 4/1987 | U.S.S.R. . |
| 1755714 | 8/1992 | U.S.S.R. . |

OTHER PUBLICATIONS

Shumski K.P., "Vacuum apparatuses and instruments" book, 1963, USSR, Moscow, "Mashgiz" Publishing house, pp. 476–477.

*Primary Examiner*—Charles G. Freay
*Assistant Examiner*—Robert Z. Evora
*Attorney, Agent, or Firm*—Mark A. Oathout

[57] ABSTRACT

The invention relates to the field of jet technology. After the required pressure of the gaseous medium at the gas inlet of a liquid-gas jet apparatus is obtained, the ratio of the liquid pressure in the nozzle of the jet apparatus to the pressure at the outlet of the jet apparatus is reduced in magnitude. Such ratio is reduced in magnitude down to the value at which an abrupt increase of gas pressure occurs at the gas inlet of the jet apparatus. This value of the ratio is fixed or determines the minimum value for such ratio. Then the final value of the ratio of the liquid pressure in the nozzle of the jet apparatus to the pressure at the outlet of the jet apparatus is set. The final value of the ratio must be greater than the fixed one. The process provides an increased efficiency for a liquid-gas jet apparatus.

4 Claims, 1 Drawing Sheet

OPERATING MODE OF A JET BLOWER

CROSS-REFERENCES TO RELATED APPLICATIONS

This application if a 371 application of PCT/RU98/00094 filed Mar. 3, 1998.

BACKGROUND OF THE INVENTION

The present invention relates to the field of jet technology, primarily to liquid-gas jet apparatuses, which are intended for creation of excessive pressure in different industrial processes.

The operational method for a liquid-gas jet apparatus is known, according to which a vacuum in a gas reservoir is generated owing to evacuation of a gaseous medium from the reservoir by the jetting of a liquid medium. The liquid medium under high pressure is delivered into the nozzle of a jet apparatus which is hydraulically connected to a reservoir (see, for example, book of K. P. Shumski, "Vacuum apparatuses and instruments", M., Mashgiz, 1963, p.476–477).

However, liquid-gas jet apparatuses implementing such an operational method have a low efficiency factor (high energy consumption). Therefore they are not widely used.

As the starting point for this invention the authors selected an operational process of a liquid-gas jet apparatus, consisting of feed of a liquid medium under high pressure into the jet apparatus' nozzle, discharge of the liquid medium through the nozzle, and evacuation and compression of a gaseous medium by the liquid jet flowing from the nozzle. The required pressure of the gaseous medium at the inlet of the jet apparatus is provided (see USSR Certificate of Authorship No. 754118, M, cl. F04 F5/02, 1980).

The imperfection of this operational process is its low efficiency since the maintaining of the required pressure at the jet apparatus' gas inlet is accompanied by considerable energy losses.

SUMMARY OF THE INVENTION

The technical problem to be solved by this invention is an increase of efficiency of a liquid-gas jet apparatus due to reduction of energy losses in said apparatus.

The solution of the problem is ensured by the following. The operational process of a liquid-gas jet apparatus, consisting of feed of a liquid medium under high pressure into a nozzle, discharge of the liquid medium through the nozzle, evacuation and compression of a gaseous medium by the liquid jet flowing from the nozzle, so that the required pressure at the gas inlet of the jet apparatus is provided, is supplemented by the following steps: after the required pressure of the gaseous medium at the gas inlet of the jet apparatus is obtained, the ratio of the liquid pressure in the nozzle of the jet apparatus to the pressure at the outlet of the jet apparatus is reduced in magnitude. Such is reduced in magnitude down to the value or magnitude at which an abrupt increase of the pressure of the gaseous medium occurs at the gas inlet of the jet apparatus. This value of the ratio is registered as the minimum value for such ratio. Then the final operational value or magnitude of the ratio of the liquid pressure in the nozzle of the jet apparatus to the pressure at the outlet of the jet apparatus is set. The final operational value of the ratio must be greater than the registered one.

It is expedient to reduce the value of the ratio of the liquid pressure in the nozzle of the jet apparatus to the pressure at the outlet of the jet apparatus either by reducing the liquid pressure in the jet apparatus' nozzle or by simultaneous boosting of pressure at the outlet of the jet apparatus and reducing the liquid pressure in the nozzle of the jet apparatus.

Experimental research has proven that specific pressures at the liquid inlet and at the outlet of a liquid-gas jet apparatus are required for maintaining the necessary pressure in any closed space, for example in a degasifier or in a vacuum rectification column. Because of the inaccuracy of existing calculation methods it is very difficult to ensure the efficiency factor of a liquid-gas jet apparatus to more than 30% when the optimal pressures at the liquid inlet and at the outlet of the jet apparatus are predetermined by calculations. It is ascertained that after the required gas pressure at the gas inlet of a liquid-gas jet apparatus is obtained, one may reduce pressure of the liquid fed into the jet apparatus, or boost pressure at the outlet of the jet apparatus, or do both simultaneously, while the gas pressure at the gas inlet of the jet apparatus remains near constant. However, each specific liquid-gas jet apparatus has its own range of values of the ratio of the liquid pressure in the nozzle to the pressure of gas-liquid mixture at the outlet, within which the suction gas pressure of this jet apparatus remains constant. This range depends on the individual design of the liquid-gas jet apparatus, the composition of the gaseous medium and other parameters. So in each specific case, after the jet apparatus comes into its normal operating regime, the ratio of the above pressures may be reduced by any of the possible methods (i.e. by reduction of the liquid pressure in the nozzle of the jet apparatus, by boosting the outlet pressure, or by a combination of both methods) in order to determine the ultimate minimal value of the ratio of pressures. To determine this value the ratio of the liquid pressure in the nozzle of the jet apparatus to the pressure at the outlet of the jet apparatus is reduced in magnitude down to the value at which an abrupt increase of pressure occurs in the gas delivery pipeline of the jet apparatus. Thusly the ultimate minimal value of the ratio of pressures is fixed. Next, the final operational value of the ratio of the liquid pressure in the nozzle of the jet apparatus to the pressure of the gas-liquid mixture at the outlet of the jet apparatus is to be set. The final operational value of the ratio must be greater than the fixed ultimate minimal value. This should allow for the required reserve depending on the stability of flow of the evacuated gaseous medium.

Such provides an increase in efficiency of a liquid-gas jet apparatus without reduction of its capability.

DETAILED DESCRIPTION OF THE INVENTION

Figure 1:
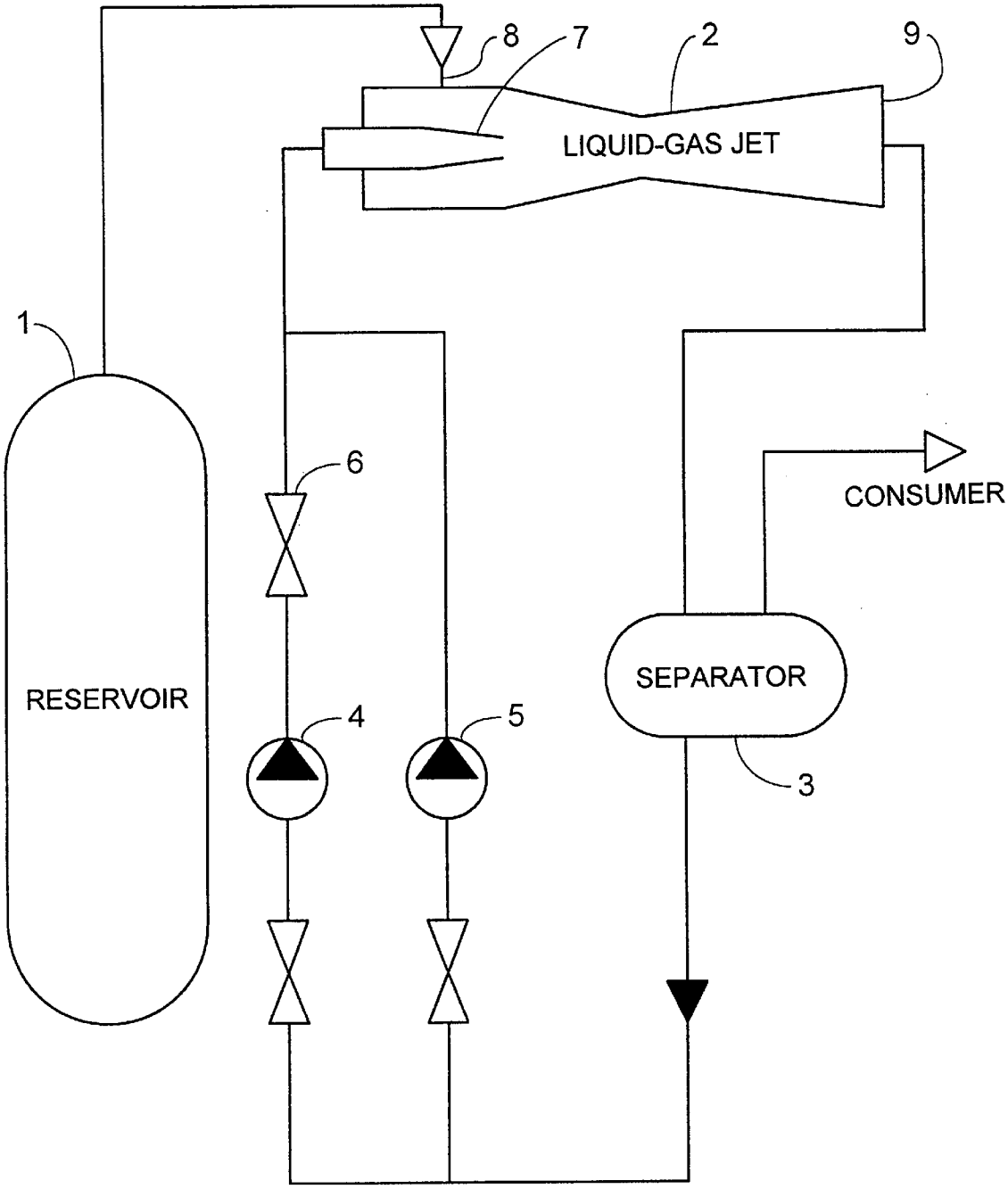
FIG. 1 represents a basic diagram of a pumping ejector unit for implementing the introduced process.

The pumping ejector unit comprising a reservoir 1, a liquid-gas jet apparatus 2, a separator 3, pumps 4 and 5, and a control device 6 (regulating valve, for example) can be cited as an illustration of an embodiment for implementing the process.

The introduced process is implemented as follows:

A liquid medium is delivered under pressure into the liquid-gas jet apparatus 2 by the pump 4. The liquid medium, flowing from the nozzle 7 of the jet apparatus 2, entrains a gaseous medium being received from the reservoir 1 through the gas inlet 8 of the jet apparatus 2. The liquid medium mixes with the gaseous medium in the jet apparatus 2. The liquid-gas mixture is compressed while passing through the jet apparatus 2 and proceeds under pressure into the separator 3. Separation of the liquid and gaseous mediums takes place in the separator 3. The liquid medium is delivered from the separator 3 by the pump 4 into the nozzle of the jet apparatus 2. The compressed gaseous medium is delivered from the separator 3 to consumers.

In the discussion which follows $P_1$=the pressure of the liquid in the nozzle 7. $P_2$=the pressure of the liquid-gas mixture at the outlet 9 of the jet apparatus 2. $P_3$=the gas pressure at the gas inlet 8 of the jet apparatus 2. After the required or operational pressure in the reservoir 1 is obtained (the pressure in the reservoir 1 is in accordance with the pressure $P_3$ at the gas inlet 8 of the jet apparatus 2), the ratio of $P_1$ to $P_2$ is reduced in magnitude. Such ratio is reduced in magnitude down to a value when or at which an abrupt increase or discontinuous rise of $P_3$ occurs. The value of the reduced ratio is fixed as the minimal permissible value of the ratio $P_1/P_2$. Then the final operational for working value of the ratio $P_1$ to $P_2$ is set. The final value of the ratio must be greater than the minimal permissible value. In other words $(P_1/P_2)$ final>$(P_1/P_2)$ minimal, where to the value of $(P_1/P_2)$ minimal is fixed or determined when there is a discontinuous rise in $P_3$.

The reduction of the ratio of pressures is effected experimentally in one of the three ways—first by throttling of the liquid flow fed into the jet apparatus 2, second by boosting of the backpressure at the outlet 9 of the jet apparatus 2, or third by varying both the first and second simultaneously.

Several variants of unit operation can be implemented after the permissible range of values of the ratio have been determined empirically. For example, the system can be furnished with the starting pump 4 and a pump 5 joined-up in parallel. The pump 5 feeds the liquid medium under a reduced pressure to the jet apparatus 2, which ensures the required ratio of pressures. Such provides for both the starting condition and the operating mode of the liquid-gas jet apparatus 2. A reservoir with liquid (not shown in the drawing) can be used instead of the pump 4 in case the unit is seldom stopped during operation. Liquid from the reservoir can be delivered into the jet apparatus by means of a compressed gas, for example, from a compressed-gas cylinder (not shown in the drawing). In this case, after the normal operating mode of the liquid-gas jet apparatus 2 is set, the reservoir with liquid may be disabled and the pump 5 may be started.

The introduced operational process for a liquid-gas jet apparatus can be applied to various pumping-ejector units, which are used in petrochemical, food and other industries.

What is claimed is:

1. An operational process for a liquid-gas jet apparatus, wherein a liquid medium under high pressure is fed into a nozzle, the liquid medium is discharged through the nozzle, a gaseous medium is evacuated and compressed by the liquid medium in a jet wherein the liquid medium flows from the nozzle such that a required pressure at a gas inlet of the jet apparatus is provided, the operational process comprises the steps of:

obtaining the required pressure of the gaseous medium at the gas inlet of the jet apparatus;

reducing in magnitude a ratio of a liquid pressure in the nozzle of the jet apparatus to a pressure at an outlet of the jet apparatus down to a value at which an abrupt increase of the gas pressure occurs at the gas inlet of the jet apparatus;

fixing the value of the ratio at which the abrupt increase occurs as a minimum value; and, setting a final operational value of the ratio of the liquid pressure in the nozzle of the jet apparatus to the pressure at the outlet of the jet apparatus wherein the final operational value of the ratio is greater than the minimal value.

2. The operational process according to claim 1, wherein the ratio of the liquid pressure in the nozzle of the jet apparatus to the pressure at the outlet of the jet apparatus is reduced in magnitude by boosting the pressure at the outlet of the jet apparatus.

3. The operational process according to claim 2, wherein the ratio of the liquid pressure in the nozzle of the jet apparatus to the pressure at the outlet of the jet apparatus is reduced in magnitude by reducing the liquid pressure in the nozzle of the jet apparatus.

4. The operational process according to claim 1, wherein the ratio of the liquid pressure in the nozzle of the jet apparatus to the pressure at the outlet of the jet apparatus is reduced in magnitude by reducing the liquid pressure in the nozzle of the jet apparatus.

* * * * *